United States Patent [19]

Terminella et al.

[11] Patent Number: 4,730,441

[45] Date of Patent: Mar. 15, 1988

[54] TRAY PACKAGE WRAPPER FOLDING ARMS

[75] Inventors: Joseph E. Terminella; Frank J. Terminella; Emanuele J. Terminella, all of Fayetteville, Ark.

[73] Assignee: Pacmac, Incorporated, Fayetteville, Ark.

[21] Appl. No.: 860,950

[22] Filed: May 8, 1986

[51] Int. Cl.[4] ..... B65B 11/18

[52] U.S. Cl. ..... 53/556; 53/226; 53/228

[58] Field of Search ..... 53/556, 226, 228, 230

[56] References Cited

U.S. PATENT DOCUMENTS

| | | | |
|---|---|---|---|
| 3,662,513 | 5/1972 | Fabbri | 53/226 X |
| 3,967,433 | 7/1976 | Bonfiglioli | 53/228 |
| 3,977,158 | 8/1976 | Jennings | 53/226 |
| 4,035,990 | 7/1977 | Hallam | 53/228 X |
| 4,078,363 | 3/1978 | Ranzi | 53/228 |
| 4,178,740 | 12/1979 | Groom | 53/226 X |
| 4,574,564 | 3/1986 | Pester | 53/556 X |

*Primary Examiner*—John Sipos

*Attorney, Agent, or Firm*—Robert R. Keegan

[57] ABSTRACT

There is disclosed an improved form of folding arms in a tray packaging wrapping machine that elevates a tray of meat or other product causing it to be wrapped on top and sides by a sheet of stretchable PVC film after which arms fold the edges of the film underneath the tray; wherein the improved folding arms move with nonrotational motion from opposing edges of the tray toward the center of the tray. Said arms have a film-engaging edge portion with a length substantially less than the width of the film sheet being folded, this edge portion being defined by an indentation in the outline of the arm at each end of the edge portion; the depth of the indentations are about 10% to about 50% of the length of the film-engaging edge portion and the transition between the film-engaging edge portion and the indentations is curved with a radius of curvature of about one-half inch. Preferably the linear motion of the opposing folding arms in opposite directions is effected by a rack and pinion mechanism with a rack associated with each arm engaging an opposing side of a fixed, freely-rotatable pinion. The conventional cam operating mechanism for the machine operates through a linkage to move one or the other of the racks and its associated arm.

15 Claims, 4 Drawing Figures

TRAY PACKAGE WRAPPER FOLDING ARMS

The present invention relates to tray package wrapper machines which are commonly used to wrap trays of meat with stretchable poly vinyl chloride or similar wrapping material so that the food product is visible to the purchaser while at the same time being maintained in a sanitary condition. Such machines are commonly used at or near the location where the product is displayed and sold; the film-wrapped tray packages are not primarily employed as a shipping package, but they may be transported when assembled in other suitable containers. Such tray package wrapping machines are at least partially automated; uncovered trays containing food products are fed into the machine by conveyor where the tray is elevated to cause it to be wrapped on top and sides with a stretchable film sheet that has previously been cut from a roll; the edges of the film sheet are thereupon folded under the tray from the two sides and from first one end and then the other to provide a transparent or partially-transparent sanitary covering for the tray. The clinging nature of the film prevents the edges from coming loose from the bottom of the tray, and the bottom of the tray is commonly heated and pressed to further secure the film in place. In accordance with recent developments in the industry, the film wrap for the tray may be partially coated with adhesive material placed to create a tight seal of high integrity on the bottom of the package.

According to the present invention, the structure of the side folding arms which fold the edges of the film underneath the tray are of a novel construction which causes the film to be more smoothly folded under the tray and greatly enhances the quality of the seal produced at the bottom of the tray. The improved arms according to the invention are even more effective when used with the adhesive-coated film mentioned above.

Previous package wrapping machines had folding arms which pivoted from points alongside the tray package and hence the arms moved toward the center of the tray with an arcuate motion. Such arcuate motion would inherently produce unevenness and wrinkles in the initial fold of the wrap underneath the tray from the respective sides of the tray. This unevenness in the folded film could not be remedied by the final folds from the back and front ends of the trays even though such folding action was linear rather than arcuate or rotational.

The improved folding arms according to the present invention have purely linear, non-rotational motion from opposing edges of the tray toward the center of the tray and in addition have a film-engaging edge portion defined by indentations in the outline of the arm. The film-engaging edge portion is of lesser length than the width of the film being folded and helps to produce a mitered fold at the corners of the package when the endfolds, particularly the first enfold, is made. As a result, the generally wrinkled gathering of the film produced in prior machines is not encountered, but rather the film is folded smoothly under the package with very few wrinkles and a mitering effect at the corners. Therefore, when the package is heated and pressed on the bottom in a later operation, and particularly if the film-wrap material has adhesive coating, a seal is produced at the bottom of the tray which virtually prevents the leak of liquids such as meat juices from the tray when it is handled by the purchaser. This eliminates a common problem with such packaging and merchandising procedure previously encountered when dripping liquids from film-wrapped meat trays would soil other products in the grocery cart or would soil the customer's clothing.

The improved arms according to the present invention are intended to be incorporated in currently commercially available machines generally of the type shown in U.S. Pat. No. 3,662,513 to Ermanno Fabbri dated May 16, 1972 titled, "METHOD AND APPARATUS FOR WRAPPING ARTICLES IN STRETCHABLE SHEET MATERIAL".

In contrast to the improved folding arms of the present invention, the folding arms in currently available machines and the Fabbri patent are pivoted and actuated with a rotational motion which is unable to produce the smooth folding action of the improved linear-motion arms of the present invention.

Underfolding film package wrapping machines of a comparable type are shown in the following patents: U.S. Pat. No. 3,540,187 to Monoghan dated Nov. 17, 1970; U.S. Pat. No. 3,967,433 to Bonfiglioli dated July 6, 1976; U.S. Pat. No. 4,388,796 to Zelnick dated June 21, 1983; and U.S. Pat. No. 4,522,013 to Hamilton dated June 11, 1985.

The above patents, like the Fabbri patent, do not have opposed co-acting folding arms with linear movement of the kind provided by the present invention.

In addition to providing the advantages and features described above, it is an object of the present invention to provide improved folding arms for a tray package wrapper wherein such folding arms are arranged for purely linear movement from the sides toward the center of the tray to produce an optimally-smooth fold of the wrapping film under the tray.

It is another object of the present invention to provide such improved folding arms wherein the action of the arms is produced in a simple and reliable manner by a rack and pinion arrangement wherein the racks associated with the respective arms engage the opposite edges of a pinion to produce equal and opposite linear motion of the arms.

It is still another object of the present invention to provide improved arms for a tray wrapping machine wherein the film-engaging edge of the arms is contoured to provide a generally straight section at right angles to the direction of motion of the arms, such film-contacting edge being of a length substantially less than the overall width of the film being wrapped around the package.

Other objects and advantages of the invention will be apparent from consideration of the following description in conjunction with the appended drawings in which.

Figure 1:
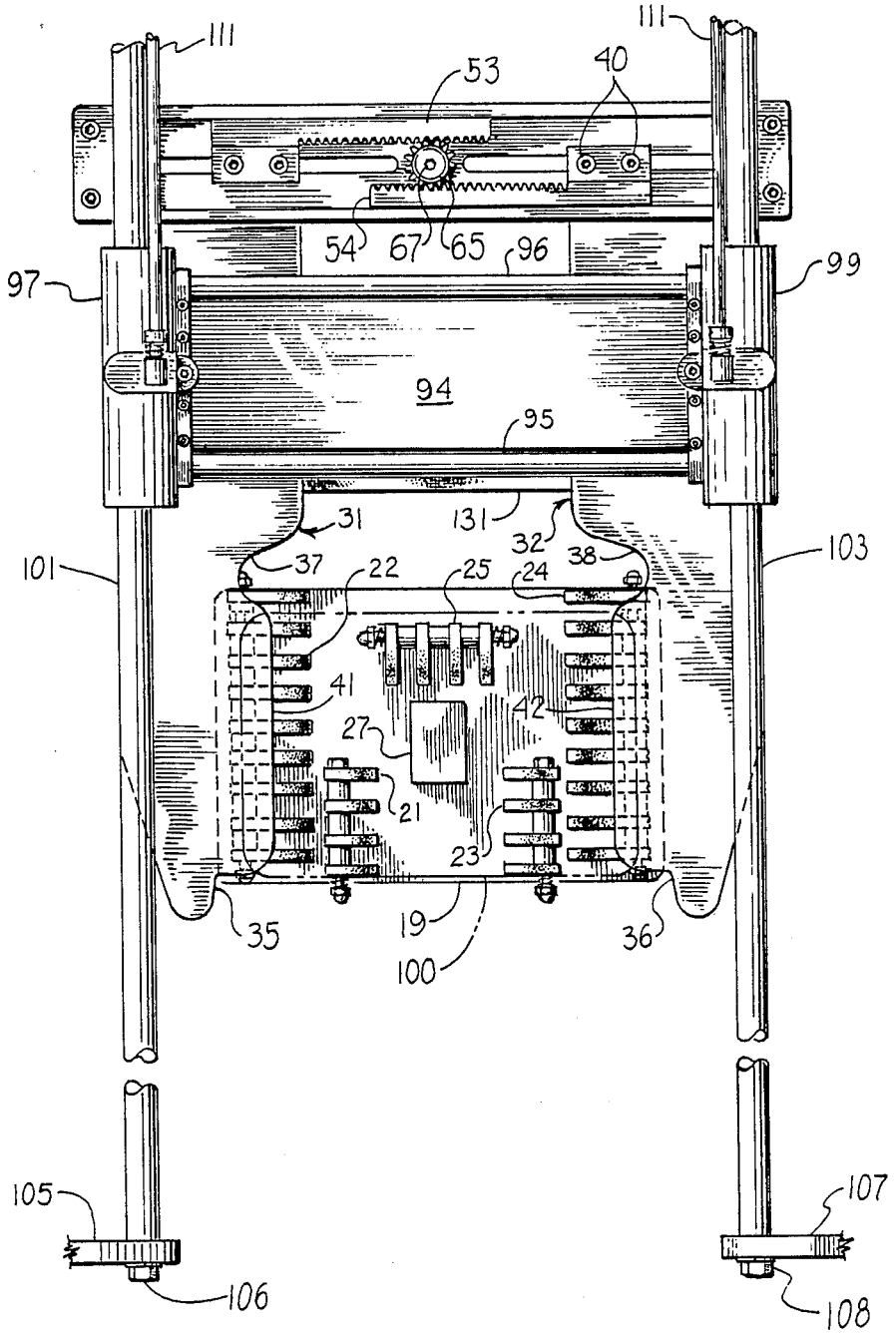
FIG. 1 is a fragmentary top plan view showing the improved folding arms according to the present invention together with the mechanism for operating the arms.
Figure 2:
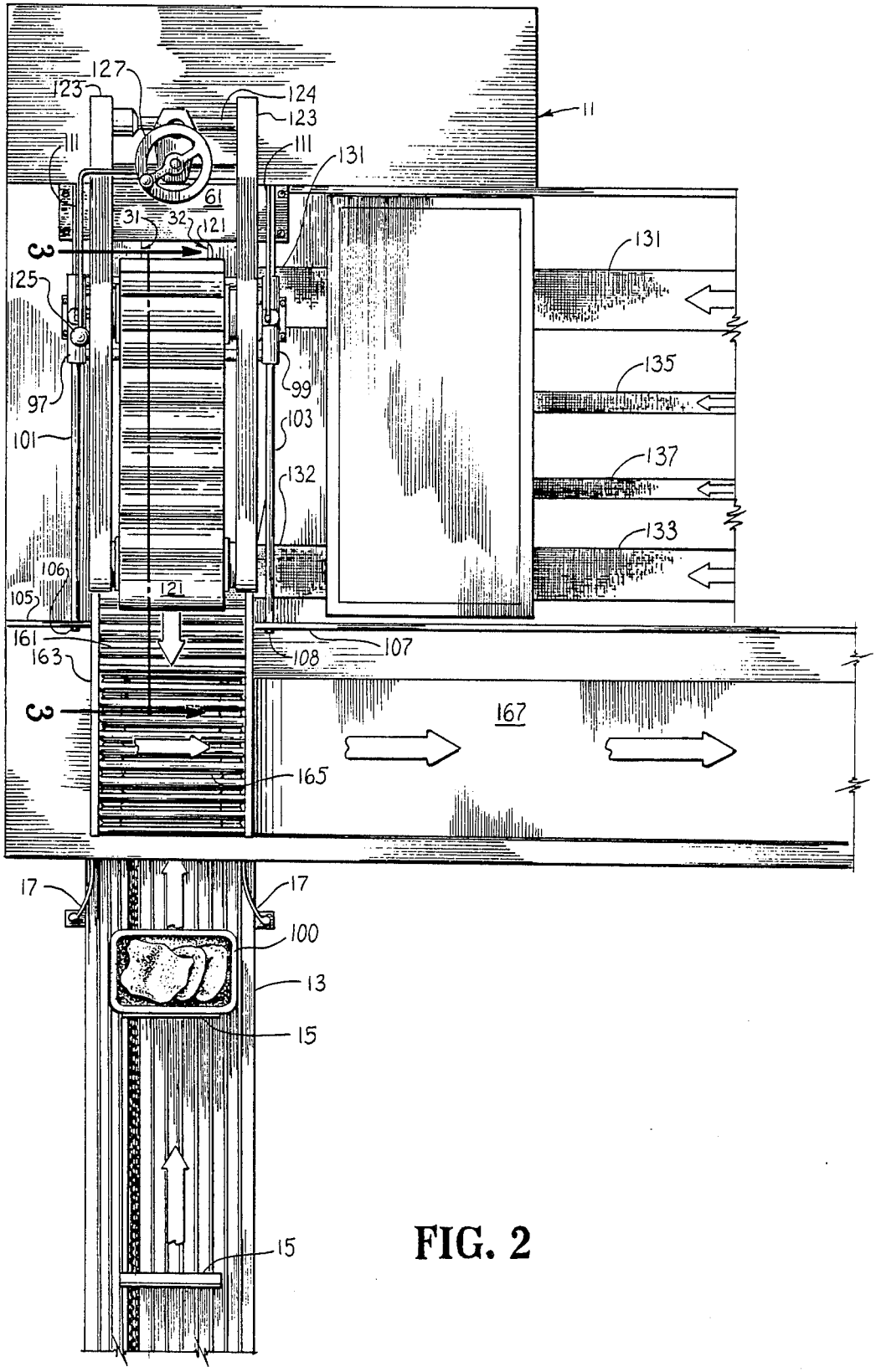
FIG. 2 is a top plan, partially fragmentary view of the wrapping machine for which the improved wrapping arms are intended.

Referring to the drawings, and particularly FIGS. 1 and 2, a wrapping machine 11 is shown having an input conveyor 13 and pusher bars 15 for conveying filled but unwrapped tray packages into the wrapping section of the machine. Guides 17 cause the trays 100 to be properly located.

An elevator plate 19 is arranged for vertical movement to lift the trays and contents to be wrapped, and the elevator plate 19 is provided with flexible finger units 21, 22, 23, 24 and 25 on three sides thereof. The finger units 21–25 may be of conventional form and are pivotally mounted with spring loading so that they will support a tray and its contents, but will yield to the folding arms as they pass under the bottom of the tray. Pillar 27 supports the center of a tray and is beyond the travel of the folding arms. The apparatus described thus far is all conventional.

Opposed side folding arms 31 and 32 are provided which are distinctly different from the conventional pivoted folding arms. They are shown half-way to their central position in FIG. 1. The outline of the arms have indentations 37 and 38 inboard of the position of tray elevator plate 19 and indentations 35 and 36 near the outer end of arms 31 and 32 respectively. These indentations 35, 36, 37, 38 define film-engaging edges 41 and 42 of arms 31 and 32 respectively. Film-engaging edges 41 and 42 are essentially linear and at right angles to the direction of motion of arms 31 and 32. Indentations 35–38 preferably have a depth of about 10% to 50% of the length of film-engaging edges 41 and 42. The transition between edges 41 and 42 and respective indentations 35, 37 and 36, 38 are curved with a radius of approximately one-half inch or more, preferably about one inch.

Figure 4:
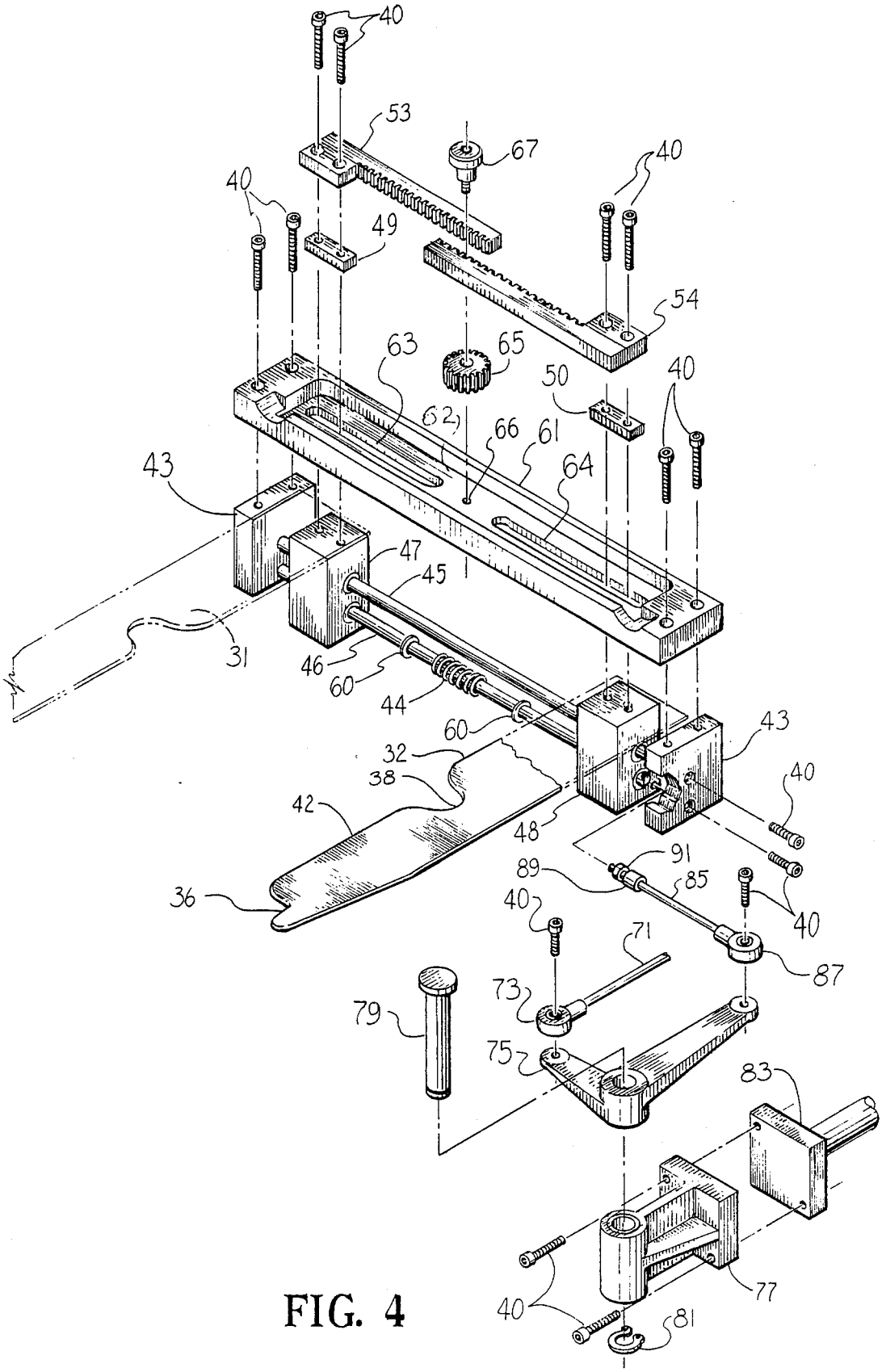
FIG. 4 is an exploded isometric view showing details of the apparatus of FIG. 1 and FIG. 3.

As more clearly seen in FIG. 4, blocks 43 are fixedly secured in the machine and support slide rods 45 and 46 on which are mounted respective slide blocks 47 and 48 to which are attached arms 31 and 32. Thus, arms 31 and 32 are restrained to linear motion (with only one degree of freedom). A bumper spring 44 and flat washers 60 slow the movement of arms 31 and 32 at the end of their inward travel for smoother operation.

Also attached to blocks 47 and 48 are racks 53 and 54 which are supported in a position spaced above blocks 47 and 48 by spacers 49 and 50; rack 53, spacer 49 and block 47 are secured together by machine screws 40. Rack 54 is similarly secured to block 48.

A bridge 61 is secured over blocks 47 and 48 supported by blocks 43 and secured thereto by machine screws 40. A depression 62 in bridge 61 accommodates racks 53 and 54 and slots 63 and 64 in bridge 61 provide room for spacers 49 and 50 to move wth sliding blocks 47 and 48. A pinion 65 is centrally located in recess 62 and is engaged on either side by racks 53 and 54 so that racks 53 and 54 are constrained to equal and opposite linear motion. Pinion 65 is secured in a fixed position with freedom of rotation by shoulder bolt 67 threadedly engaged in tapped hole 66.

A rod 71 is connected to the conventional cam-operating and timing system (not shown) of the wrapping machine. Rod 71 has secured on the end thereof a bearing 73 which is secured by machine screw 40 to the short end of a bell crank line 75 thereby converting the linear motion of rod 71 into rotational motion of bell crank 75. Bell crank 75 is rotatably secured by pin 79 on a fixed bracket 77 and locked by snap ring 81. Bracket 77 is supported from the frame of the wrapping machine by posts set 83 secured by machine screws 40.

The long end of bell crank 75 is connected through bearing 87 secured by machine screw 40 to rod 85 which is connected by flexible connector 89 and threaded stud 91 to sliding block 48.

Thus, it will be seen that the wrapping machine conventional operating and timing mechanism operates rod 71 at a portion of the cycle when side folding arms 31 and 32 are to be actuated, and this causes bell crank 75 to rotate whereupon rod 85 imparts linear motion to both sliding block 48 and folding arm 32. Racks 53 and 54 and pinion 65 constrain folding arm 31 to move in an opposite direction to arm 32. Thus, the arms 31 and 32 move together to fold the stretchable film under the product tray. At the conclusion of the operation, an opposite motion of rod 71 actuated by the cam mechanism of the machine retracts arms 31 and 32.

Referring now to FIGS. 1 and 2, an endfolding plate 94 together with cylindrical braces 95 and 96 are mounted for sliding movement on rails 101 and 103 by carriage slides 97 and 99. Rails 101 are secured to machine frame members 103 and 107 by bolts 106 and 108. Operating rods 111 move carriage slides 97 and 99 and with them the endfolding plate 94 and braces 95 and 96, all in a conventional manner not forming part of the present invention.

Figure 3:
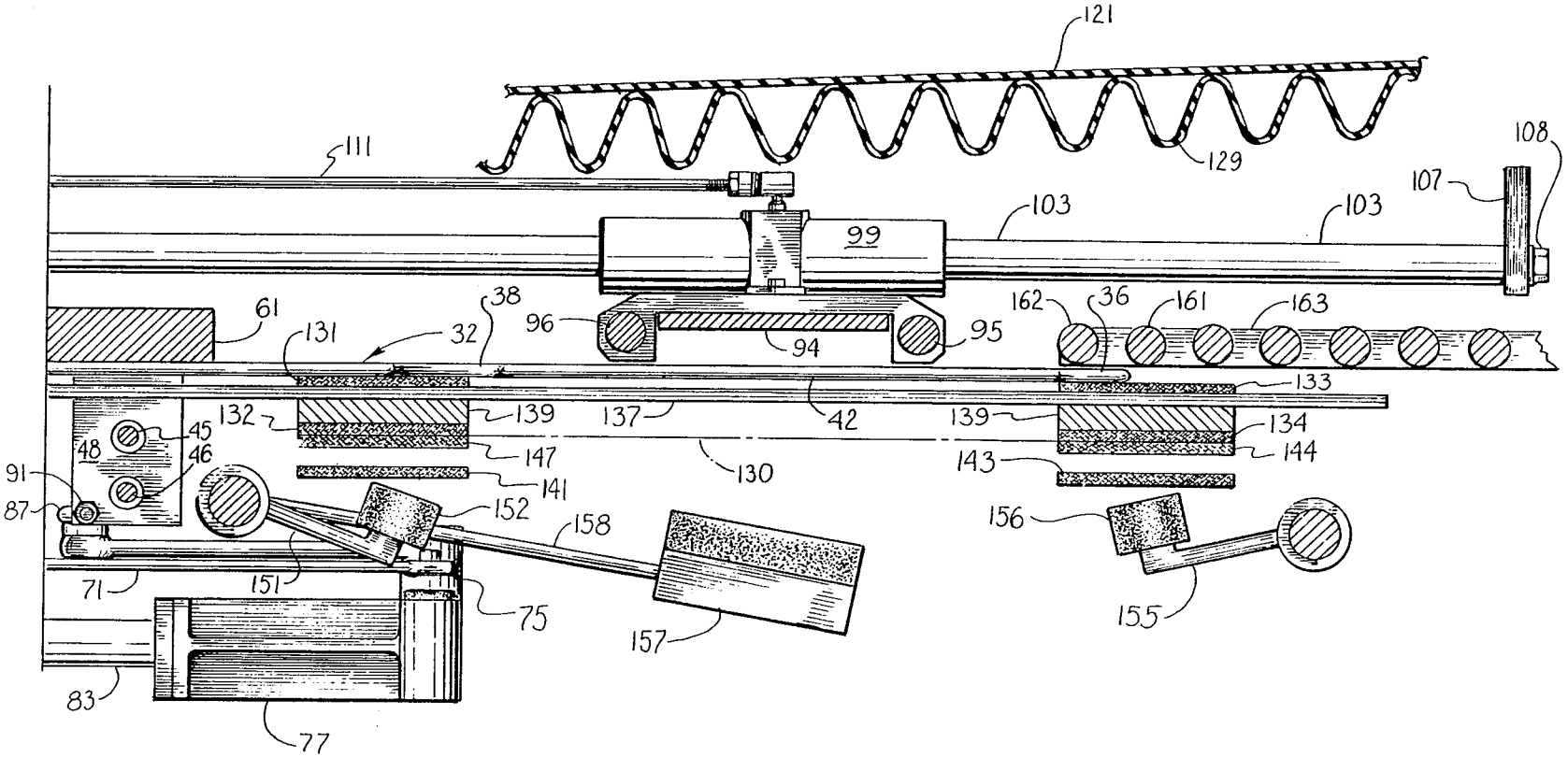
FIG. 3 is a partially-sectioned fragmentary view taken along the line 3—3 in FIG. 2.

Referring also to FIG. 3, an endless belt 121 is supported above the elevator 19 by arms 123 which are pivotally supported on shaft 124 so that endless belt 121 may be lifted up to gain ready access to the central part of the wrapping mechanism using lever handle 125. The vertical position of belt 121 is adjustable for different package heights by handwheel 127 which operates a conventional screw thread mechanism not shown. Belt 121 is normally provided with a corrugated outer surface material 129, both belt 121 and material 129 being formed of flexible plastic. The function of belt 121 is to finish the cycle for the wrapping of one package by frictionally contacting the top of the package and rotating so that the lower surface of belt 121 ejects the package onto a gravity roller conveyor 161 and thence onto belt conveyor 163 having belts 165 which transport the trays to conveyor 167. Conveyor 167 normally leads to the heat and pressure sealing apparatus for sealing the plastic film on the bottom of the tray.

The placement of the improved side folding arms according to the present invention may be seen in more detail relative to the other machine apparatus by reference to FIG. 3. The initial position of the stretchable film wrapping material is shown by the dot-dash line 130 in FIG. 3. As shown in FIG. 2, the film is fed into the machine from a roll (not shown) by outer film transport belts 131 and 133 and inner film transport belts 135 and 137. The upper return portion of these belts is shown in FIG. 2 and may also be seen in FIG. 3; also the film-contacting portion of the upper outer belts 131 and 133 is shown at 132 and 134. The film-contacting (upper) portions of lower outer transport belts is shown at 147 and 144 while the return portion is shown at 141 and 143. The mechanism which transports the film to the wrapping section and separates a sheet of it from the roll of PVC film is not relevant to the present invention and is not shown in detail here.

In the preliminary stage of the wrapping operation gripping levers 151 and 155 with respective resilient pads 152 and 156 rotate upwardly to pinch the wrapping film between belts 132 and 147 or 134 and 144 and thus hold the edges of the film while elevator 19 is being raised to its upward position. Bars 139 back up belts 132 and 134. An additional lever 158 and gripping pad 157 (and a companion lever and pad not shown in FIG. 3)

hold the other edges of the wrapping film sheet against plate 137.

As seen in FIG. 3, folding arm 32 (and also folding arm 31, not shown in FIG. 3) is positioned immediately above the return portions of the upper transport belts 131 and 133 and thus is spaced only slightly above belts 132 and 134 and plate 137 where the edges of the film are being positioned by pads 152, 156 and 157.

As arms 31 and 32 move toward the center of the elevator 19, the edges of the film sheet are released by pad 157 (and its companion not shown) so that the film is smoothly folded under the tray by the linear motion of the straight film-contacting edges 41 and 42 of the arms 31 and 32. For clarity, the elevator 19 and fingers 21–25 are not shown in FIG. 3.

The third edge of the PVC film sheet is folded by back endfolding plate 94 together with the brace 95 as slide 99 moves from left to right in FIG. 3. The fourth and final edge is folded when belt 121 is actuated to eject the tray products and film sheet to the right in FIG. 3 onto gravity roller conveyor 161. Cylinder 162 of the roller conveyor 161 presses the fourth edge of the film underneath the tray.

Smooth wrapping of the third and fourth edges of the film under the tray is accommodated by indentations 35, 36, 37 and 38 which create a generally mitered corner for the film wrap under the tray and avoid bunching or wrinkling of the film. The smooth wrap of the film is important so that the subsequent heat and pressure sealing operation on the bottom of the tray will produce a secure and liquid-tight seal. Previous rotating arm arrangements were incapable of making smooth, flat and straight folds that would consistently avoid bunching or crumpling of the film underneath the tray. Consequently, the subsequent heat and pressure sealing operation would often leave openings for the leaking of meat juices or other liquids from the trays.

From the foregoing description and explanation, it will be seen that the improved folding arm configuration and operating mechanism according to the present invention implements the wrapping of trays with wrapping machines modified according to the invention in a manner which produces far superior smoothness and uniform lay of the film on the bottom of the tray; this in turn produces virtually liquid-tight seals when the trays are passed through the subsequent heat and pressure sealing operation.

Furthermore, the nature of the operating mechanism for the arms of the present invention is such that it can be accommodated to existing commercial wrapping machines without extensive modifications to other parts of the machine.

Although a preferred embodiment of apparatus wherein the improved folding arms of the invention are operated by purely mechanism linkages with the existing machine cam-operating mechanism has been shown and described, it will be appreciated that the desired linear motion of the arms could be obtained by equivalent hydraulic or air cylinders, electrically-operated linear actuators or other known mechanisms.

In addition to the variations in the apparatus described or suggested, other variations or modifications in the apparatus will be apparent to those of ordinary skill in the art, and the scope of the invention is not to be considered limited to the preferred variations or embodiments but is rather to be determined by reference to the appended claims.

What is claimed is:

1. In apparatus for wrapping plastic film around a container such as a food tray including entry transport means, elevator means, coordinated link actuation means, film sheet gripping means and exit transport means, the improvement comprising a first and a second elongated folding arm each having one partially-constrained end and one free end and being positioned adjacent said elevator means with their long dimensions substantially parallel, each said arm being in a horizontal plane below the uppermost position of said elevator means and above the position of said sheet gripping means, each of said arms having an outline with a film-engaging edge portion extending in the direction of the width of the film and of a length substantially less than the width of the film sheet being folded, said edge portion being defined by indentations in the outline of said arm at the ends of said edge portion , the depth of said indentations being from about 10% to about 50% of the length of said film-engaging edge portions, means for constraining the partially constrained end of each said arm for substantially non-rotational movement in a horizontal plane in a direction substantially transverse to its long dimension, means for coupling said first arm to said link actuation means for causing motion of said first arm toward the center of said elevator means subsequent to elevation of said container by said elevator means, and means for coupling said second arm to said link actuation means for causing the motion of said second arm to be in a direction opposite to that of said first arm.

2. Apparatus as recited in claim 1 wherein said means for constraining the partially-constrained end of each said arm comprises two parallel vertically separated fixed shafts and an arm-mounting fixture with linear bearings running on said shafts.

3. Apparatus as recited in claim 1 wherein said means for coupling said second arm to said link actuation means includes a pair of racks coupled to a free-running pinion causing said racks to have opposite directions of motion, a first of said racks being attached to said second arm and a second of said racks being coupled to move with said link actuation means and said first arm.

4. Apparatus as recited in claim 1 wherein said means for coupling said first arm to said link actuation means includes a bell crank for converting link motion parallel to the longitudinal axis of said arm to motion substantially perpendicular to said axis.

5. Apparatus as recited in claim 1 wherein the transition between said film-engaging edge portion and said indentations is curved with a radius of curvature of about one-half inch or more.

6. Apparatus as recited in claim 5 wherein said film-engaging edge portions have a length about equal to the dimension of the corresponding side of said trays and the combined length of said edge portion and indentations is substantially greater than said dimension.

7. In apparatus for wrapping plastic film around a container such as a food tray including entry transport means, elevator means, coordinated link actuation means, film sheet gripping means and exit transport means, the improvement comprising a first and a second rigid elongated folding arm each having one partially-constrained end and one free end and extending along one side of said elevator means positioned with its long dimension substantially parallel to the motion direction of said container imparted by said exit transport means, each said arm being in a horizontal plane below the uppermost position of said elevator means and above the position of said sheet gripping means, said arms being oppositely displaced from the center of said elevator means, each of said arms having an outline with a film-engaging edge portion extending in the direction of the width of the film and of a length substantially less than the width of the film sheet being folded, said edge portion being defined by indentations in the outline of said arm at the ends of said edge portion , the depth of said indentations being from about 10% to about 50% of the length of said film-engaging edge portions, means for constraining the partially-constrained end of each said arm for substantially non-rotational movement in a horizontal plane in a direction substantially transverse to its long dimension, means for coupling said first arm to said link actuation means for causing motion of said first arm toward the center of said elevator means subsequent to elevation of said container, and means for coupling said second arm to said link actuation means for causing the motion of said second arm to be in a direction opposite to that of said first arm.

8. Apparatus as recited in claim 7 wherein said means for constraining the partially-constrained end of each said arm comprising a pair of fixed shafts and an arm-mounting fixture with linear bearings running on said shafts.

9. Apparatus as recited in claim 7 wherein said means for coupling said second arm to said link actuation means includes a pair of racks coupled to a free-running pinion causing said racks to have opposite directions of motion, a first of said racks being attached to said second arm and a second of said racks being coupled to move with said link actuation means and said first arm.

10. Apparatus as recited in claim 7 wherein said means for coupling said first arm to said link actuation means includes a bell crank for converting link motion parallel to the longitudinal axis of said arm to motion substantially perpendicular to said axis.

11. Apparatus as recited in claim 8 wherein the transition between said film-engaging edge portion and said indentations is curved with a radius of curvature of about one-half inch or more.

12. Apparatus as recited in claim 11 wherein said film-engaging edge portions have a length about equal to the dimension of the corresponding side of said trays and the combined length of said edge portion and indentations is substantially greater than said dimension.

13. Folding arm apparatus for a machine for wrapping food trays in plastic film sheets comprising a pair of elongated folding arms, mounting structure for mounting said folding arms in a parallel opposed relationship for partially-constrained non-rotational linear motion in a direction transverse to the longitudinal axis of said arms, said arms having generally similar outlines each with a film-engaging edge portion extending in the direction of the width of the film and with a length substantially less than the width of the film sheet being folded, said edge portion being defined by indentations in the outline of said arm at the ends of said edge, the depth of said indentations being from about 10% to about 50% of the length of said film-engaging edge portion.

14. Apparatus as recited in claim 13 wherein the transition between said film-engaging edge portion and said indentations is curved with a radius of curvature of at least one inch.

15. Apparatus as recited in claim 14 wherein said film-engaging edge portions have a length about equal to the dimension of the corresponding side of said trays and the combined length of said edge portion and indentations is substantially greater than said dimension.

* * * * *